United States Patent [19]

Krautz et al.

[11] 4,334,341

[45] Jun. 15, 1982

[54] BUCKLE FOR A SAFETY BELT

[75] Inventors: Kurt Krautz, Rosengarten; Erhard Ender, Hamburg-Lurup, both of Fed. Rep. of Germany

[73] Assignee: Autoslug Stakupress GmbH & Co., Fed. Rep. of Germany

[21] Appl. No.: 143,794

[22] Filed: Apr. 25, 1980

[30] Foreign Application Priority Data

Jul. 20, 1979 [DE] Fed. Rep. of Germany ..... 2929394

[51] Int. Cl.[3] ..... A44B 11/26

[52] U.S. Cl. ..... 24/230 AT

[58] Field of Search ..... 24/230 AT, 230 A, 230 AK, 24/201 A

[56] References Cited

U.S. PATENT DOCUMENTS 3,146,846 9/1964 Gutshall ..... 24/230 AT X
3,262,169 7/1966 Jantzen ..... 24/230 AT
3,605,210 9/1971 Lohr ..... 24/230 AT
3,631,571 1/1972 Stoffel ..... 24/230 A

FOREIGN PATENT DOCUMENTS 1350887 12/1963 France ..... 24/230 AT

*Primary Examiner*—Dennis L. Taylor
*Attorney, Agent, or Firm*—Prutzman, Kalb, Chilton & Alix

[57] ABSTRACT

The invention relates to a buckle for a safety belt, which buckle contains two symmetrically disposed swivel latches (9) which cooperate with indentations (11) lying opposite one another in the insertable tongue (7). In order to ensure that both swivel latches will always conjointly engage in the indentations in the insertable tongue, according to the invention the swivel latches are joined together by a drive arrangement so as to make a common movement. This drive arrangement may be formed by two levers (12,13), each of which is joined to one swivel latch (9) and whose ends are joined so as to make a common movement.

3 Claims, 4 Drawing Figures

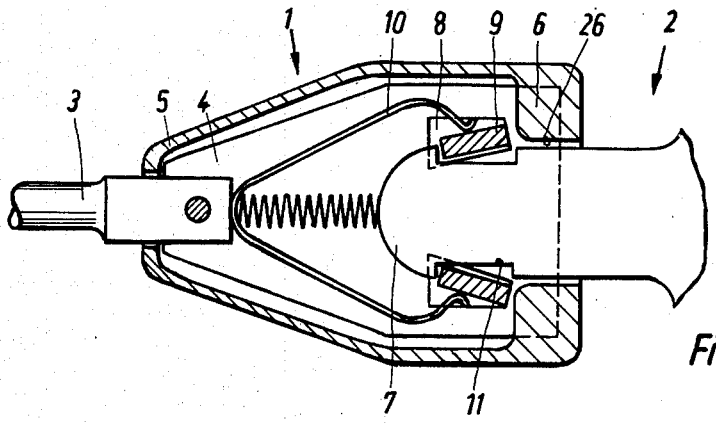
Fig. 1
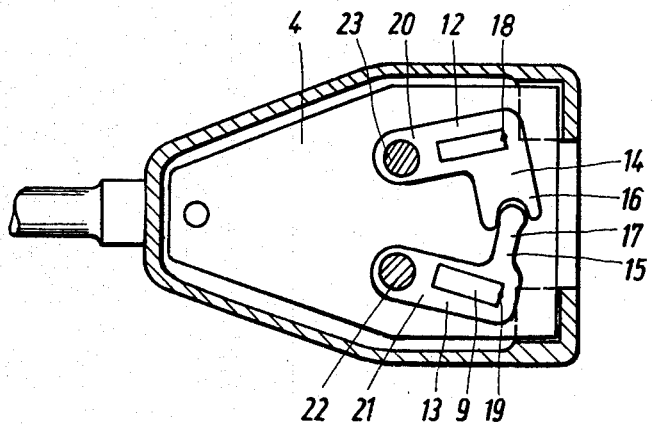
Fig. 2
Fig. 3
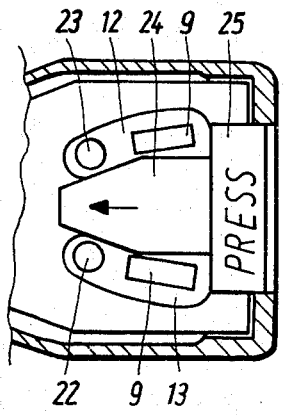
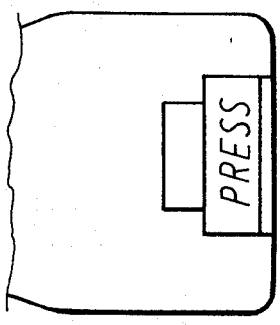
Fig. 4

BUCKLE FOR A SAFETY BELT

The invention relates to a buckle for a safety belt, consisting of an insertable tongue having two symmetrically disposed lateral indentations and of a lock for receiving the insertable tongue in a guide channel which is formed between two lock plates and which on its two shorter sides carries swivel latches for engagement in the indentations in the insertable tongue, the swivel latches being held swivellably in cutouts in the lock plates.

In one known buckle of this kind (LE-OS No. 26 50 498) the two swivel latches are movable independently of one another. This entails the disadvantage that only one of the two latches may conceivably be engaged in the insertable tongue, while the other remains unlocked. This can for example occur when the insertable tongue is inserted only so far into the lock that only one of the two latches can snap into the appertaining indentation, while the other is not yet able to engage. This then leads to inadequate securing of the insertable tongue in the lock.

The problem underlying the invention therefore consists in providing a buckle of this kind which ensures secure locking of the two swivel latches.

The solution according to the invention comprises joining the swivel latches together by a drive arrangement so as to make a common movement. It preferably consists of two levers, which are rotationally fixed at the ends of the swivel latches, extend towards one another, and engage positively one in the other at their ends, one lever reaching around the end of the other. If it should occur that the tongue is not inserted sufficiently far for both latches to engage, the drive arrangement according to the invention ensures that even the latch first reached by an indentation in the tongue will not engage. Since neither of the two latches then holds the tongue fast, it is not possible for the user to be given the impression that correct locking has been achieved when perhaps only one of the two latches has actually engaged.

The solution according to the invention is surprisingly simple and inexpensive, because in any case a pressing must be attached to each of the latch ends in order to operate the latches. The latches are therefore expediently formed by these pressings, which on the other hand are each provided with a lever extending substantially in the longitudinal direction of the lock, while an opening wedge cooperates with the ends of these levers.

The invention is explained more fully below with reference to the drawing, in which:

FIG. 1 is a longitudinal section through the buckle between the lock plates,

FIG. 2 a section, parallel to FIG. 1, outside a lock plate,

FIG. 3 a section similar to FIG. 2 but taken rather further outwards, and

FIG. 4 is a side view of the lock, corresponding in the direction of view to FIGS. 1 to 3.

The buckle consists of the lock 1 and of the insertable tongue 2. Two lock plates 4 of identical shape, of which the lower can be seen in FIG. 1 and the upper in FIG. 2, are made fast, parallel to one another, to a fastening part 3 which in turn is anchored by means of a rope to the vehicle body. They are held a determined distance apart by the fastening part 3 and by projections 6 which are provided on a casing 5 surrounding the lock and which penetrate between the plates 4. This distance is so selected that the space formed between the plates is slightly wider than the thickness of the insertable tongue 2, so that the insertable part 7 of the tongue 2 is guided securely but with easy slidability between the plates. The projections 6 on the lock casing moreover form guide surfaces 26 on the shorter sides of the guide passage formed for the insertion of the tongue 2 between the plates 4. These guide surfaces cooperate with the edges of the insertable part 7 of the tongue 2. A swivel latch 9 is held in cutouts 8 which are provided in each of the two plates, in line with one another and disposed symmetrically to the centre plane of the lock. Each swivel latch is supported at its end shown on the right in FIG. 1 in the appertaining cutout. The left-hand portion of the cutouts is made wide enough to enable the swivel latch to make a swivelling movement into and out of the indentation in the tongue. In so doing it turns about the point of contact between its right-hand end and the appertaining supporting surface of the cutouts 8. The point of contact or swivelling centre is indicated at 18 and 19 in FIG. 2.

At its left-hand end each swivel latch forms an end face for cooperating with the insertable tongue. The swivel latches 9 are urged by a spring 10 inwards into the guide passage, where they then snap into indentations 11 in the tongue 2. In this respect the arrangement can be regarded as known.

FIG. 2 shows a view of the outer side of a lock plate 4 and of the ends of the swivel latches 9 which pass through this plate. Pressings 12,13, preferably of a low-friction plastics material such as polyamide, are mounted on these ends so as to be non-rotatable. The pressing 12 forms a lever arm 14 extending transversely to the longitudinal direction of the lock. A lever arm 15 extends from the pressing 13 towards the said lever arm 14. At its end 16 the lever arm 14 is formed as a jaw and fittingly embraces a head 17 formed at the end of the other lever 15. If the upper swivel latch in FIG. 2 is turned in the clockwise direction, the end 16 of the lever 14 moves towards the left, carrying the end 17 of the lever 15 with it, and thus turns the lower swivel latch in the counterclockwise direction, and vice versa. The swivel latches can therefore move inwards into the indentations in the tongue 2, on the insertion of the latter, under the action of the spring 10 only when both have reached their respective indentations.

The pressings 12,13 are lengthened towards the left in the longitudinal direction of the lock. They are flat and carry projections 22,23 which project transversely to the plane of the lock plates 4 and between which lies an opening wedge 24 (FIG. 3), which extends in a plane above the main dimension of the pressings 12,13. When the opening wedge 24 is pushed to the left in the direction of the arrow by pressure on its handle 25, the projections 22, 23 are moved apart, whereby the swivel latches 9 are swivelled into the open position.

We claim:

1. A safety belt buckle assembly having an insertable tongue plate and a tongue lock with a pair of opposed spaced plates forming a guide channel therebetween for forward longitudinal insertion of the tongue plate into and rearward longitudinal withdrawal of the tongue plate from a locking position therein, the pair of opposed plates having laterally spaced pairs of opposed latch member openings on opposite sides of the longitudinal axis of insertion and withdrawal of the tongue plate, a pair of swivel members having latching members extending across the guide channel and received within the pairs of opposed latch member openings respectively for engagement by the tongue plate upon longitudinal insertion thereof into the guide channel, the pairs of opposed openings being contoured to provide pairs of aligned generally forwardly facing pivot shoulders for engagement by the latch members for lateral pivotal movement of the swivel members about axes symmetrically located relative to said longitudinal axis, spring means pivotally biasing the swivel members inwardly toward each other to inner pivotal locking positions thereof, the latching members and tongue plate having, with the tongue plate inserted to its locking position and the latching members in their inner pivotal locking positions, pairs of longitudinally opposed locking shoulders for latching the tongue plate against rearward longitudinal withdrawal from the tongue lock, the swivel members having respective lever members, with respective laterally spaced release followers longitudinally forwardly of the locking shoulders of the latching members and means coacting to provide for combined pivotal operation of the swivel members, and a lock release slide longitudinally reciprocable for engaging the release followers and pivot the swivel members outwardly from their inner locking positions to release the tongue plate.

2. The safety belt buckle assembly according to claim 1 wherein the lever members of the swivel members are made of plastic.

3. A safety belt buckle assembly according to claim 1 or 2 wherein the latching members have opposed longitudinally extending faces engageable by the tongue plate to pivot the swivel members outwardly upon said forward longitudinal insertion of the tongue plate to its locking position.

* * * * *